US006123204A

United States Patent [19]

Nelson et al.

[11] Patent Number: 6,123,204

[45] Date of Patent: Sep. 26, 2000

[54] DISHWASHER-RACK CONTAINER HOLDER

[75] Inventors: David W. Nelson; Ron C. La Gro, both of Chicago, Ill.

[73] Assignee: Belden Enterprises, Inc., Chicago, Ill.

[21] Appl. No.: 09/351,863

[22] Filed: Jul. 12, 1999

[51] Int. Cl.[7] ..... A47G 19/08

[52] U.S. Cl. ..... 211/41.9

[58] Field of Search ..... 211/41.9, 41.8, 211/85.4, 41.2, 126.1, 126.9

[56] References Cited

U.S. PATENT DOCUMENTS

| | | | |
|---|---|---|---|
| 808,824 | 1/1906 | Eick . | |
| 843,826 | 2/1907 | Kloeppinger . | |
| 1,798,387 | 3/1931 | Taylor . | |
| 2,213,918 | 9/1940 | Lofstrand, Jr. . | |
| 2,741,392 | 4/1956 | Weiss . | |
| 3,258,127 | 6/1966 | Cushing . | |
| 3,289,854 | 12/1966 | Kauffman . | |
| 4,193,588 | 3/1980 | Doneaux . | |
| 4,271,878 | 6/1981 | Bologa . | |
| 4,836,392 | 6/1989 | Constantino | 211/41.9 |
| 4,909,401 | 3/1990 | McConnell . | |
| 4,927,033 | 5/1990 | Patera et al. . | |
| 4,974,806 | 12/1990 | Matern | 211/41.9 |
| 5,104,168 | 4/1992 | Magee . | |
| 5,195,711 | 3/1993 | Miller et al. . | |
| 5,249,590 | 10/1993 | Jacobus et al. . | |
| 5,820,094 | 10/1998 | Tanaka . | |
| 5,918,749 | 7/1999 | Pille et al. | 211/41.9 |

*Primary Examiner*—Alvin Chin-Shue
*Assistant Examiner*—Sarah Purol
*Attorney, Agent, or Firm*—Brinks Hofer Gilson & Lione

[57] ABSTRACT

A dishwasher-rack container holder is disclosed that securely holds containers in place during washing so that pressure from spraying streams of water will not upset containers placed therein. This ensures that a container held in the container holder will be properly cleaned and will not be dislodged from the rack, thereby eliminating the danger that a dislodged container will interfere with drainage, become damaged by heating coils, or burn out the dishwasher motor. In one preferred embodiment, a container is inserted into the holder by pushing the container into the top of the holder, while in another preferred embodiment, a container is inserted through the side of the holder. The container holder can be shaped to secure onto any rail (top, bottom, or side) of a dishwasher rack and can accommodate a variety of container sizes. The container holder can be further shaped to be removably and rotatably secured to a dishwasher rack rail so that the holder can be removed or rotated when not in use.

19 Claims, 4 Drawing Sheets

Fig. 2
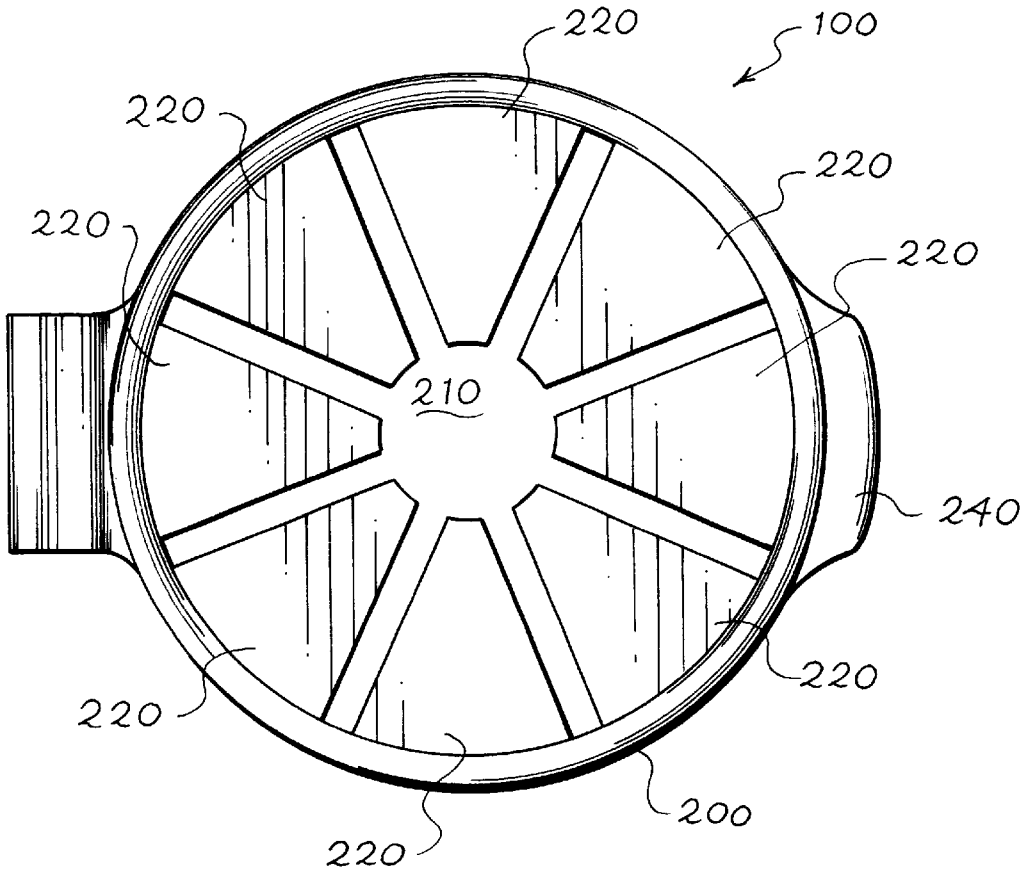
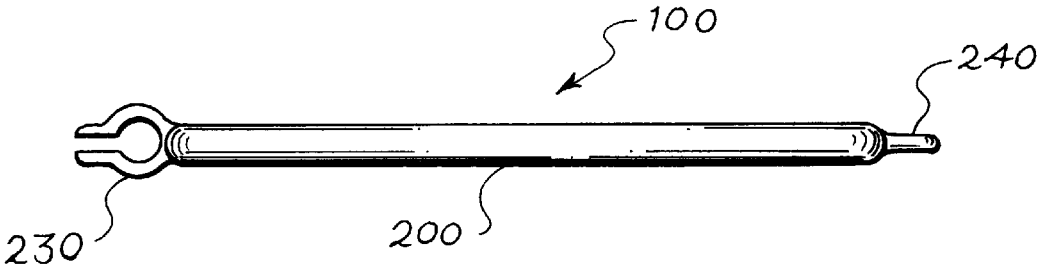
Fig. 3

DISHWASHER-RACK CONTAINER HOLDER

BACKGROUND

Automatic dishwashers conventionally use open racks that are movable out of the dishwasher chamber so that items to be washed can be loaded into the dishwasher. These open racks usually contain a plurality of elongated spaced-apart rods. Items to be washed in the dishwasher can be rested on the rack or placed upon the rods for further support. During the washing operation, streams of water spray over the items supported on the racks.

One disadvantage associated with the conventional dishwashing operation is that pressure from the spraying streams of water can upset light-weight plastic items (such as baby bottles and water bottles) and glass stemware, causing them to fall over or become dislodged from the rack. If an item falls over, a pool of water can collect in the item. For example, if a baby bottle is turned from an upright position to a horizontal position, a pool of water can collect in the baby bottle, thereby preventing proper cleaning and drying of the bottle. If a dislodged item falls to the bottom of the dishwasher, the item can interfere with drainage, become damaged by heating coils at the bottom of the dishwasher, or burn out the dishwasher motor. Further, if the dislodged item is made of glass, the dislodged item may break.

There is, therefore, a need for a dishwasher-rack container holder that will overcome the disadvantages described above.

SUMMARY

The present invention is defined by the following claims, and nothing in this section should be taken as a limitation on those claims.

By way of introduction, the preferred embodiments described below include a dishwasher-rack container holder that securely holds containers in place during washing, thereby overcoming the disadvantages described above. Because the container holder securely holds containers in place during washing, pressure from spraying streams of water will not upset containers placed therein—even containers made of light-weight plastic (such as baby bottles and water bottles). Also, because the container holder retains containers in an upright position during the washing cycle, a container held in the container holder will be properly cleaned and will not be dislodged from the rack, thereby eliminating the danger that a dislodged container will interfere with drainage, become damaged by heating coils, or burn out the dishwasher motor.

In one preferred embodiment, a container is inserted into the holder by pushing the container into the top of the holder, while in another preferred embodiment, a container is inserted through the side of the holder. The container holder can be shaped to secure onto any rail (top, bottom, or side) of a dishwasher rack and can accommodate a variety of container sizes. The container holder can be further shaped to be removably and rotatably secured to a dishwasher rack rail so that the holder can be removed or rotated when not in use.

The preferred embodiments will now be described with reference to the attached drawings.

BRIEF DESCRIPTION OF THE DRAWINGS

FIG. 2 is a plan view of a dishwasher-rack container holder of a presently preferred embodiment.

FIG. 3 is a side view of the dishwasher-rack container holder of FIG. 2.

DETAILED DESCRIPTION OF THE PRESENTLY PREFERRED EMBODIMENTS

Figure 1:
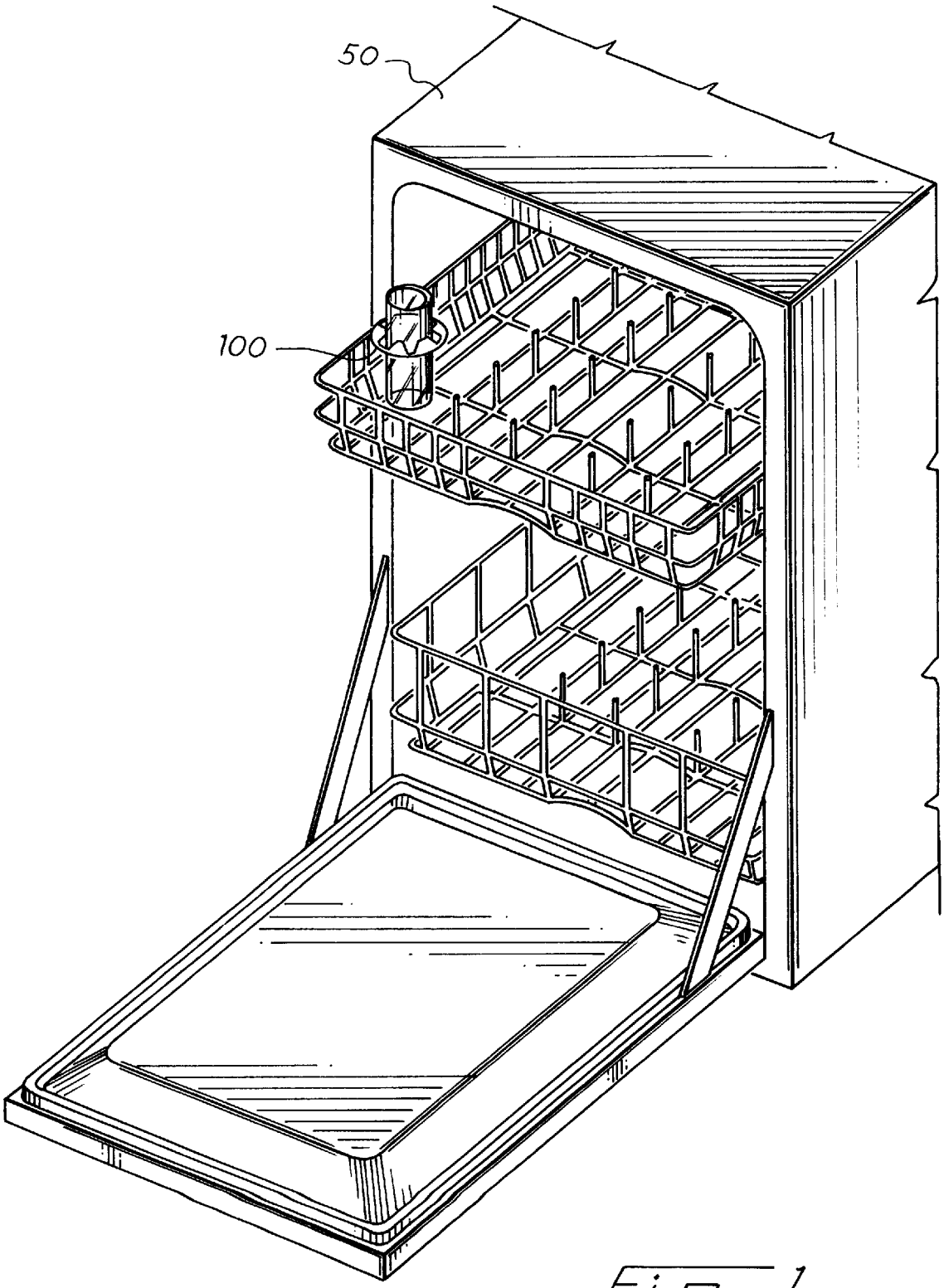
FIG. 1 is a perspective view of a dishwasher with a dishwasher-rack container holder of a presently preferred embodiment.

Turning now to the drawings, FIG. 1 is a perspective view of a dishwasher 50 with a dishwasher-rack container holder 100 of a first preferred embodiment. FIG. 2 is a plan view of the dishwasher-rack container holder 100 of FIG. 1. As shown in FIG. 2, the dishwasher-rack container holder 100 comprises a support member 200, which in the embodiment shown in FIG. 2 has a substantially annular shape that defines an opening 210. A plurality of resiliently-flexible retention members 220 extend from the support member 200 inwardly into the opening 210. In the embodiment shown in FIG. 2, the plurality of resiliently-flexible retention members 220 extend into the opening 210 from the inner perimeter of the support member 200. As will be described below, the plurality of resiliently-flexible retention members 220 are sized and shaped to removably retain containers of varying sizes within the opening 210. While the plurality of resiliently-flexible retention members 220 are in the form of eight triangular-shaped wedges in the embodiment shown in FIG. 2, it is important to note than any suitable number and shape can be used.

In operation, instead of resting a container on the dishwasher rack or placing the container upon an extending rod in the rack, the container can be pushed into the opening 210 through the plurality of resiliently-flexible retention members 220. As the container is penetrably received within the opening 210, the plurality of resiliently-flexible retention members 220 deflect and exert an inward biasing effect against the container, thereby retaining the container in the support member 200. Because the retention members 220 are flexible, the container can be easily removed from the container holder 100. Additionally, the flexibility of the retention members 220 allows for a variety of different size containers to be held by the container holder 100. For example, the container holder 100 can hold bottles with diameters varying between the diameter of the support member 200 (the greatest deflection of the retention members 220) and the diameter of the shape defined by the outer tips of the retention members 220 (zero deflection of the retention members 220).

FIG. 3 is a side view of the dishwasher-rack container holder 100 of FIG. 2. As shown in FIG. 3, the support member 200 is shaped to secure onto a dishwasher rack, thereby allowing the container holder 100 to be used on pre-existing dishwasher racks. In the preferred embodiment shown in FIG. 3, a securing member 230 (here, a "C" shape) is formed on the support member 200. The "C" shape securing member 230 engages more that half of the circumference of a rail of a dishwasher rack. The material and shape of the support member 200 can be selected such that the container holder 100 can be removed (i.e., releasably secured) to a dishwasher rack, allowing the container holder 100 to be added to and removed from the rack as needed. It is important to note than other shapes can be used for the securing member, such as the shapes described below in conjunction with FIG. 7.

Figure 5:
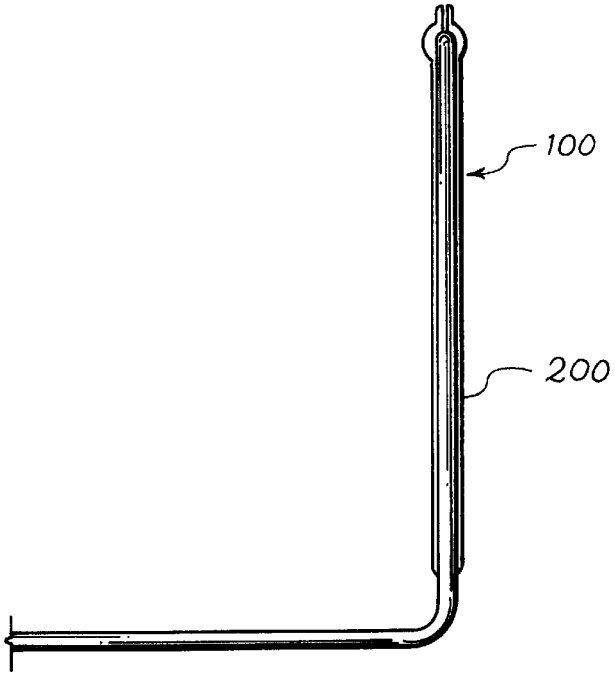
FIG. 5 is a side view of a dishwasher-rack container holder in a rotated-down position on a dishwasher rack.
Figure 4:
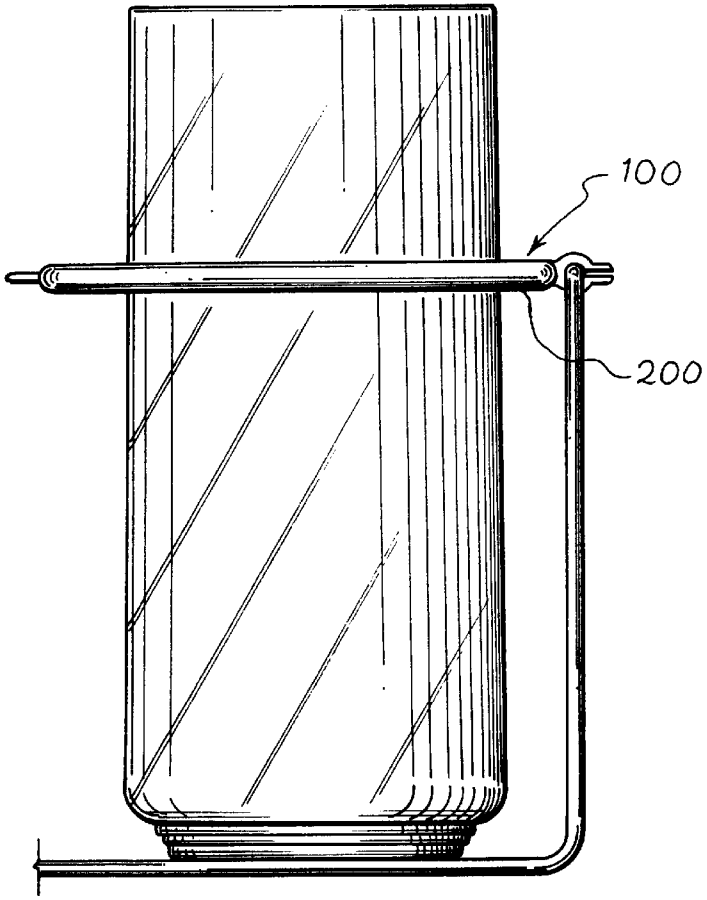
FIG. 4 is a side view of a dishwasher-rack container holder in an in-use position on a dishwasher rack.

As shown in FIGS. 4 and 5, the support member 200 can be shaped to be rotatably secured to a dishwasher rack, allowing the container holder 100 to be rotated up to an in-use position (FIG. 4) or down to a storage position to provide more room in the rack (FIG. 5). In the preferred embodiment shown in FIGS. 2 and 3, the support member 200 further contains a protrusion 240 to assist a user in rotating the container holder 100.

The use of the container holder 100 described above overcomes the disadvantages faced by conventional dishwasher racks. Because the container holder 100 securely holds containers in place during washing, pressure from spraying streams of water will not upset containers placed therein—even containers made of light-weight materials (such as baby bottles and water bottles). Because the container holder 100 retains containers in an upright position during the washing cycle, a container held in the container holder 100 will be properly cleaned and will not be dislodged from the rack, thereby eliminating the danger that a dislodged container will interfere with drainage, become damaged by heating coils, or burn out the dishwasher motor. Additionally, the container holder 100 easily secures onto any rail (top, bottom, or side) of a dishwasher rack and accommodates a variety of container sizes.

Figure 6:
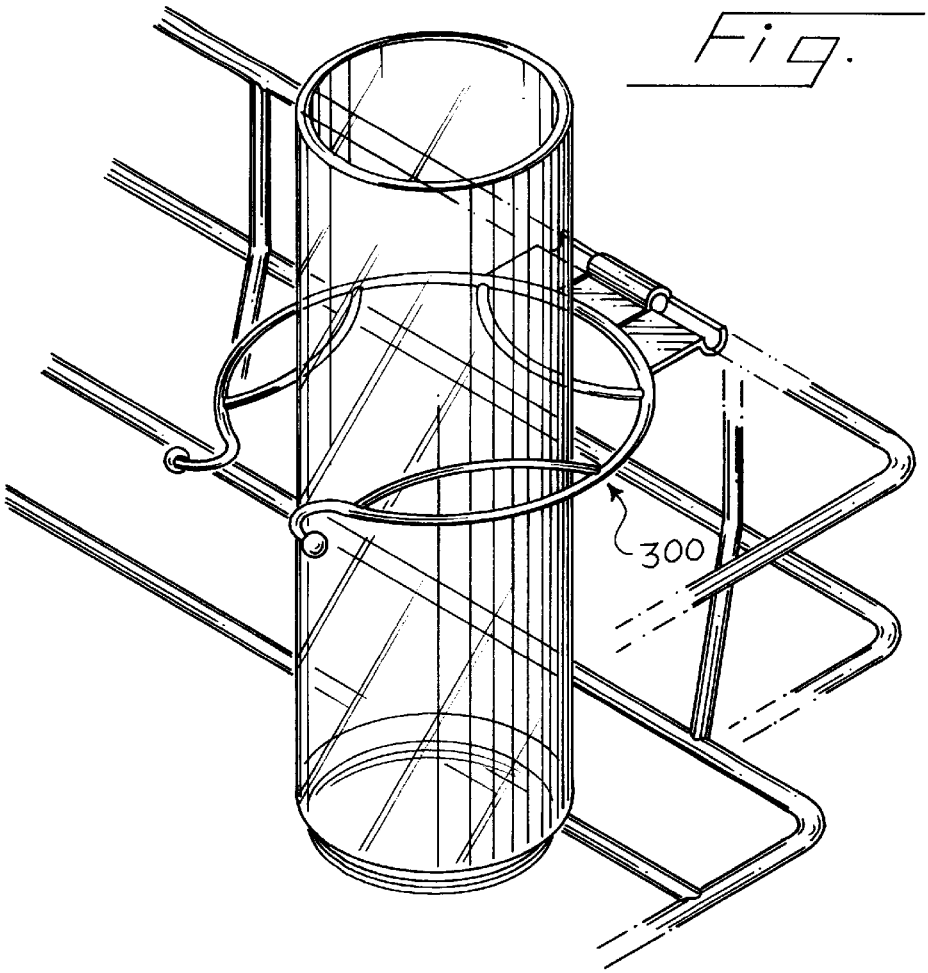
FIG. 6 is a perspective view of a dishwasher-rack container holder of another presently preferred embodiment on a rack of a dishwasher.
Figure 7:
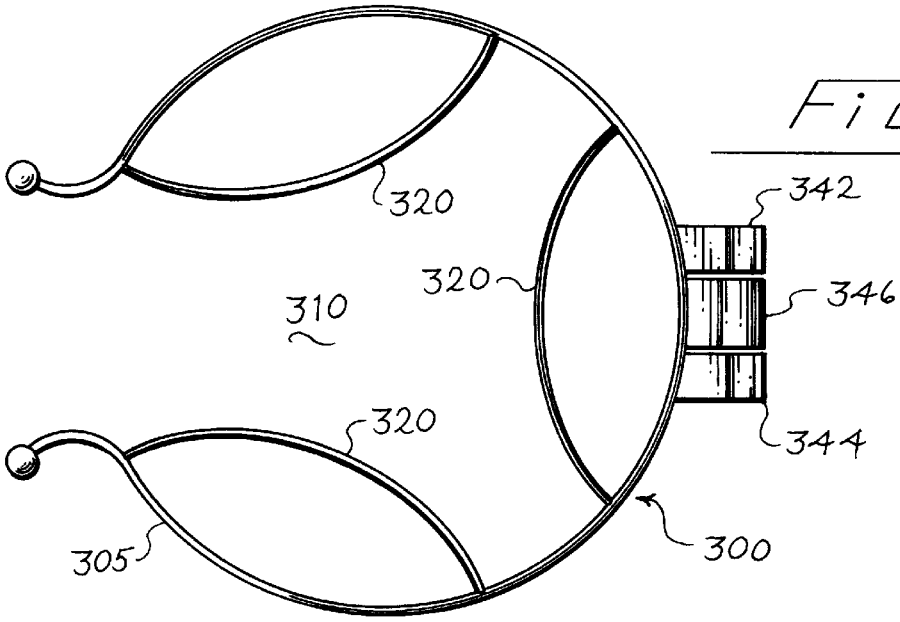
FIG. 7 is a plan view of the dishwasher-rack container holder of FIG. 6.

Turning again to the drawings, FIG. 6 is a perspective view and FIG. 7 is a plan view of a dishwasher-rack container holder 300 of another presently preferred embodiment. Like the container holder 100 of FIG. 2, the container holder 300 of this preferred embodiment comprises a support member 305 defining an opening 310. A plurality of resiliently-flexible retention members 320 extend from the support member 305 inwardly into the opening 310 and are sized and shaped to removably retain containers of varying sizes with the opening 310. In this preferred embodiment, the plurality of resiliently-flexible retention members 320 are in the form of arc-shaped bands.

In operation, a container is pushed through a gap in the side of the container holder 300. As the container is pushed through the gap, the support member 305 flexes to receive the container. After the container is received by the support member 305, the support member 305 moves back toward its original position and the plurality of resiliently-flexible retention members 320 flex inwardly and exert a biasing effect against the container, thereby retaining the container in the support member 305. Because both the support member 305 and the retention members 320 move in this embodiment, a variety of different size containers to be held by the container holder 300. For example, the container holder 300 can hold bottles with diameters varying between a diameter greater than the support member 305 (such as when the diameter of the container is larger than the diameter of the support member 305) and the diameter of the shape defined by the undeflected retention members 320.

In this preferred embodiment, the dishwasher-rack container holder 300 is shaped to secure onto a dishwasher rack with two outer securing members 342 and 344 and one inner securing member 346 oriented in the opposite direction from the two outer securing members 342 and 344. When the container holder 300 is clipped onto a rail of a dishwasher rack, the two outer securing members 342 and 344 and the inner securing member 346 engage opposite sides of the rail.

It is important to note that other securing member shapes can be used. For example, the "C" shape design shown in FIG. 3 can be used.

There are several alternatives to the preferred embodiments described above. For example, the container holder can be made integral with a dishwasher rack. Further, while the support member is shown to have a substantially annular shape, other shapes (e.g., square, rectangular, triangular, oval) can be used. Also, the support member and the retention members can be a single-piece device or can be individual members attached with any suitable means. Additionally, although only a single container holder is shown above secured to the dishwasher rack, several container holders (either individual holders or holders joined together) can be secured to the rack.

With regard to the embodiment shown in FIG. 2, it is presently preferred that the container holder have eight resiliently-flexible retention members, each about one inch long and that the support member have an inner diameter of about 3.25 inches. It is further presently preferred that the support member and the retention members be made from TPE plastic.

For simplicity, the term "container" has been used in the specification and following claims to refer to any item that is placed in a dishwasher for washing and that can be held by any of the container holders described herein. It should be understood that any type of container can be used. Examples of a "container" include, but are not limited to, cups, glasses, and bottles (such as a baby bottle or a water bottle) of any type of material (e.g., plastic, glass, metal, etc.). Further, a "container" is not limited to items designed to hold a beverage. For example, a "container" can be a dish, bowl, or any other type of item (e.g., a utensil) that can be placed in any of the container holders described herein.

The foregoing detailed description has described only a few of the many forms that this invention can take. For this reason it is intended that this detailed description be regarded as an illustration and not as a limitation of the invention. It is only the following claims, including all equivalents, that are intended to define the scope of this invention.

What is claimed is:

1. A dishwasher-rack container holder for holding containers of varying sizes in a dishwasher, the container holder comprising:

a support member shaped to secure onto a rail of a dishwasher rack of a dishwasher, the support member defining an opening; and a plurality of resiliently-flexible retention members extending inwardly into said opening from the support member, the plurality of resiliently-flexible retention members sized and shaped to removably retain containers of varying sizes, wherein in response to a container being received within said opening, the plurality of resiliently-flexible retention members deflect and exert an inward biasing effect against said container to removably retain said container within the support member.

2. The invention of claim 1, wherein the support member comprises a substantially closed shaped and wherein said container is penetrably received within said opening.

3. The invention of claim 1, wherein the support member comprises an open shape defining a gap portion, and wherein said container is received by the support member through said gap portion.

4. The invention of claim 1, wherein the plurality of resiliently-flexible retention members extend from an inner perimeter of the support member.

5. The invention of claim 1, wherein the support member is shaped to releasably secure to a rail of a dishwasher rack.

6. The invention of claim 1, wherein the support member is shaped to engage more that half of a circumference of a rail of a dishwasher rack.

7. The invention of claim 1, wherein the support member comprises a plurality of securing members, at least two of which are shaped to grasp opposite sides of a rail of a dishwasher rack.

8. The invention of claim 1, wherein the support member further defines a protrusion shaped to be grasped by a user to rotate the container holder about a rail of a dishwasher rack.

9. The invention of claim 1, wherein at least one of the plurality of resiliently-flexible retention members is triangular shaped.

10. The invention of claim 1, wherein at least one of the plurality of resiliently-flexible retention members is an arc-shaped band.

11. A dishwasher-rack container holder for holding containers of varying sizes in a dishwasher, the container holder comprising:

a substantially closed-shaped support member defining an opening;

a securing member formed on the support member and shaped to secure the container holder onto a rail of a dishwasher rack of a dishwasher; and a plurality of resiliently-flexible retention members extending inwardly into said opening from an inner perimeter of the support member, the plurality of resiliently-flexible retention members sized and shaped to removably retain containers of varying sizes, wherein in response to a container being penetrably received within said opening, the plurality of resiliently-flexible retention members deflect and exert an inward biasing effect against said container to removably retain said container within the support member.

12. The invention of claim 11, wherein the securing member is shaped to releasably secure onto a rail of a dishwasher rack.

13. The invention of claim 11, wherein the support member comprises a substantially annular shape.

14. The invention of claim 11 further comprising a protrusion formed on the support member, the protrusion being shaped to be grasped by a user to rotate the container holder about a rail of a dishwasher rack.

15. The invention of claim 11, wherein at least one of the plurality of resiliently-flexible retention members is triangular shaped.

16. A dishwasher-rack container holder for holding containers of varying sizes in a dishwasher, the container holder comprising:

a substantially open-shaped, resiliently-flexible support member defining an opening and a gap portion;

a securing member formed on the support member and shaped to secure the container holder onto a rail of a dishwasher rack of a dishwasher; and a plurality of resiliently-flexible retention members extending inwardly into said opening, the plurality of resiliently-flexible retention members sized and shaped to removably retain containers of varying sizes, wherein in response to a container being inserted through the gap portion, the support member flexes to receive the container and wherein in response to the container being received within said opening, the plurality of resiliently-flexible retention members deflect and exert an inward biasing effect against said container to removably retain said container within the support member.

17. The invention of claim 16, wherein the securing member is shaped to releasably secure onto a rail of a dishwasher rack.

18. The invention of claim 16 further comprising a protrusion formed on the support member, the protrusion being shaped to be grasped by a user to rotate the container holder about a rail of a dishwasher rack.

19. The invention of claim 16, wherein at least one of the plurality of resiliently-flexible retention members is an arc-shaped band.

* * * * *

UNITED STATES PATENT AND TRADEMARK OFFICE

CERTIFICATE OF CORRECTION

PATENT NO. : 6,123,204
DATED : September 26, 2000
INVENTOR(S) : David W. Nelson et al.

It is certified that error appears in the above-identified patent and that said Letters Patent is hereby corrected as shown below:

Claim 1,
Line 11, change "sizes," to -- sizes; --.

Claim 6,
Line 2, change "that half" to -- than half --.

Claim 11,
Line 13, change "sizes," to -- sizes; --.

Claim 16,
Line 12, change "sizes," to -- sizes; --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*